US006270323B1

(12) United States Patent
Hsu

(10) Patent No.: US 6,270,323 B1
(45) Date of Patent: Aug. 7, 2001

(54) HYDRAULIC POWER CONVERSION DEVICE

(76) Inventor: Tien-Lung Hsu, P.O. Box 82-144, Taipei (TW)

( * ) Notice: Subject to any disclaimer, the term of this patent is extended or adjusted under 35 U.S.C. 154(b) by 0 days.

(21) Appl. No.: 09/422,644

(22) Filed: Oct. 22, 1999

(51) Int. Cl.[7] ..... F04B 41/04
(52) U.S. Cl. ..... 417/399; 60/581
(58) Field of Search ..... 417/399, 269; 60/579, 581, 550, 553, 582; 303/114.1, 119.1, 115.4, 114.3; 91/42

(56) References Cited

U.S. PATENT DOCUMENTS 4,438,629 * 3/1984 Sato et al. ..... 60/579
4,543,791 * 10/1985 Burgdorf et al. ..... 60/550
4,552,414 * 11/1985 Fujii et al. ..... 303/115.4
4,843,819 * 7/1989 Leiber ..... 60/550
4,848,848 * 7/1989 Klein ..... 303/114.3
5,161,449 * 11/1992 Everett, Jr. ..... 91/42
6,079,209 * 6/2000 Hsu ..... 60/581

* cited by examiner

*Primary Examiner*—Teresa Walberg
*Assistant Examiner*—Quang Van
(74) *Attorney, Agent, or Firm*—A & J

(57) ABSTRACT

A hydraulic power conversion device includes a main oil container, a pair of hydraulic pumps, a motor, a twin-circuitry hydraulic cylinder mechanism including a first hydraulic cylinder, a first piston, a piston rod, a sealer, a second piston, a high pressure leakage proof packing and a second hydraulic cylinder, the first hydraulic cylinder having same length as the second hydraulic cylinder but having a smaller diameter than the second hydraulic cylinder, the first hydraulic cylinder being connected with the second hydraulic cylinder by screws, the sealer being fitted between the first and second hydraulic cylinders to form two regions, the second hydraulic cylinder having an inlet provided with a first check valve and an outlet provided with a second check valve, an oil retrieving container connected with the inlet of the second hydraulic cylinder, and a hydraulic pressure storage trough.

3 Claims, 12 Drawing Sheets

HYDRAULIC POWER CONVERSION DEVICE

BACKGROUND OF THE INVENTION

The conventional power conversion devices fall into two categories, i.e. the electric motor and the internal combustion engine. However, the former requires electric power for operation which is high in cost thereby making it unfit for practical use, while the latter uses the combustion of gasoline or diesel to generate power which will inevitably be accompanied with noise and air pollution.

Therefore, it is an object of the present invention to provide a hydraulic power conversion device which can obviate and mitigate the above-mentioned drawbacks.

SUMMARY OF THE INVENTION

It is the primary object of the present invention to provide a hydraulic power conversion device which can supply steady and smooth power to a driving tool.

It is another object of the present invention to provide a hydraulic power conversion device which will not produce noise and air pollution in use.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts. Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
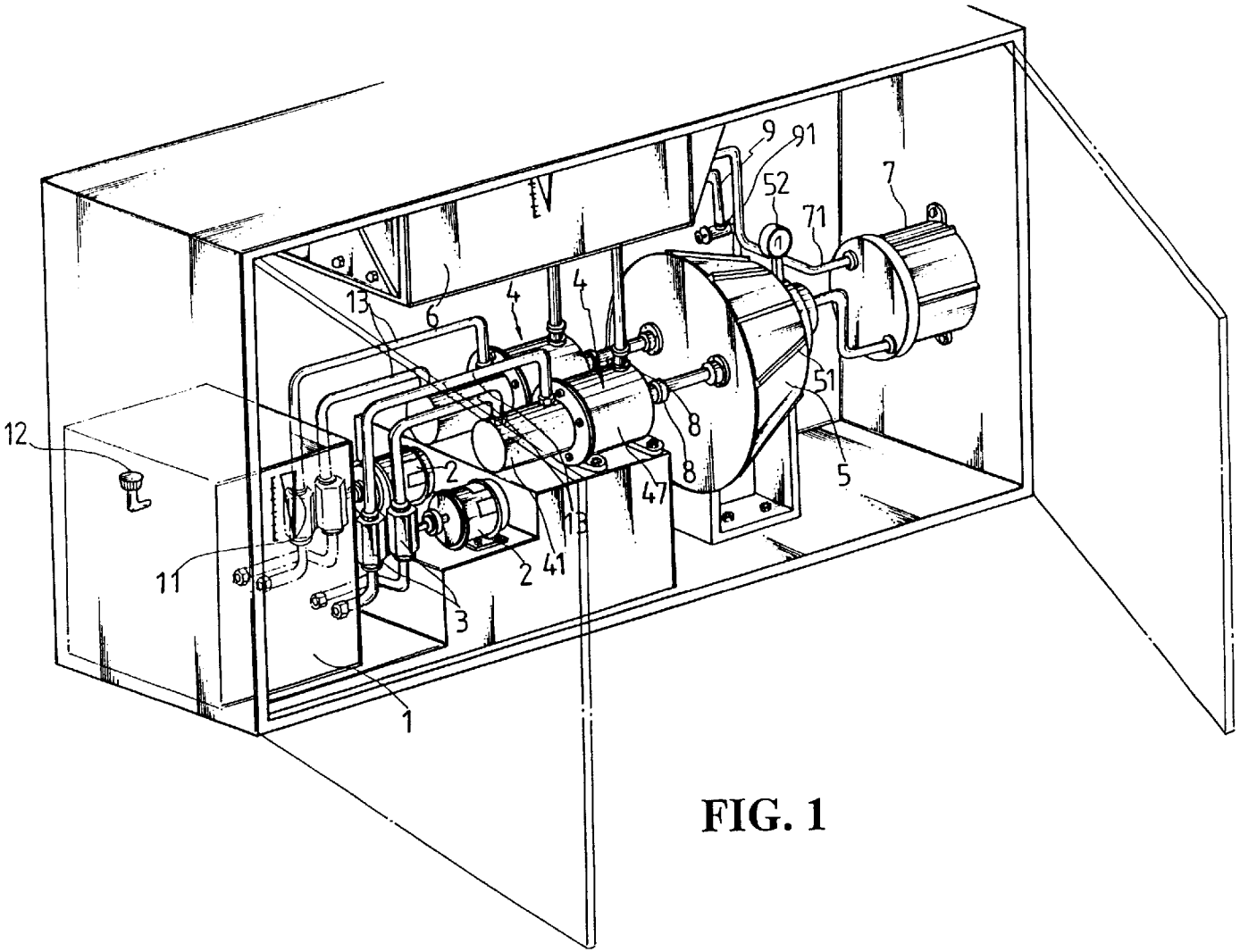
FIG. 1 is a perspective view of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Referring to FIG. 1, the present invention generally comprises a main oil container 1, a motor 2, a pair of hydraulic pumps 3, a twin-circuitry hydraulic cylinder mechanism 4, a hydraulic pressure storage trough 5, an oil retrieving container 6 and a driving tool 7. The main oil container 1 is used for receiving hydraulic oil and provided with a window 11 for inspection and an inlet 12 for supplementing oil. The main oil container 11 is connected to the two hydraulic pumps 3 and the motor 2 by means of high pressure tubing 13. The motor 2 is used for driving the hydraulic pump 3 to work at high speed thereby forcing the oil to flow from the main oil container 11 into a hydraulic cylinder 41. As shown in FIGS. 3, 3A, 3B and 4, the oil is only used for forcing the piston 42 to reciprocate within the hydraulic cylinder 41.

Figure 2:
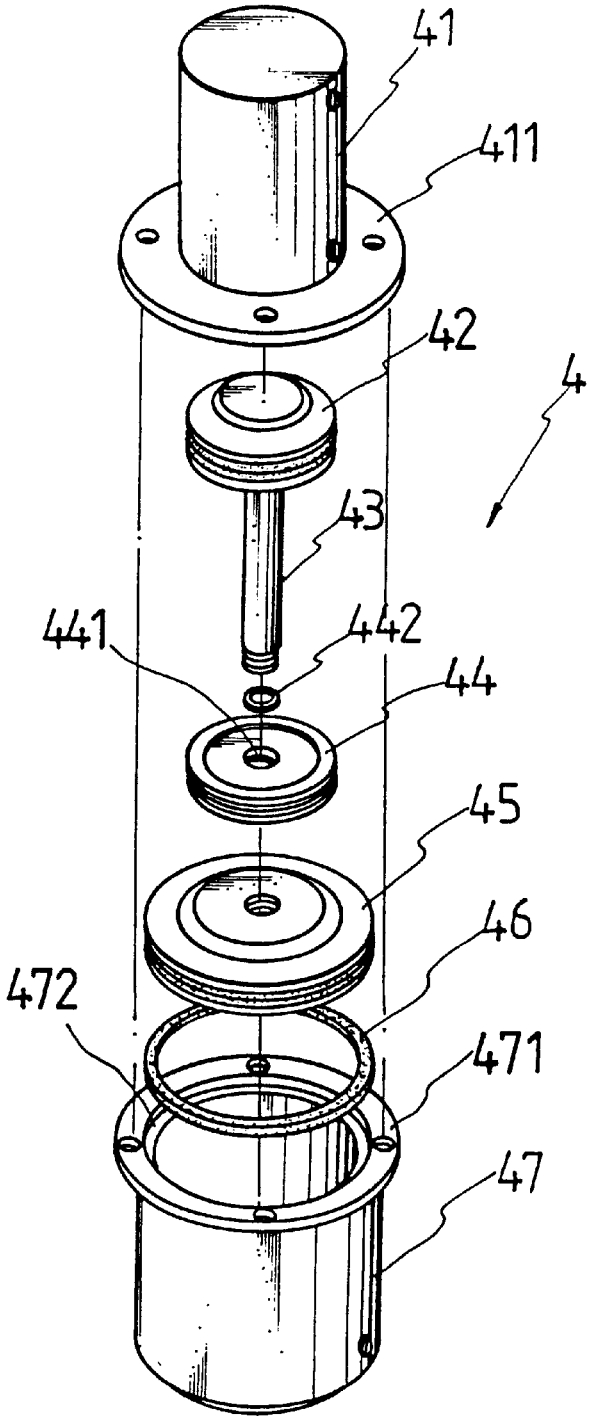
FIG. 2 is an exploded view of the twin-circuitry hydraulic cylinder mechanism.

Referring to FIG. 2, the twin-circuitry hydraulic cylinder mechanism 4 is basically composed of a first hydraulic cylinder 41, a first piston 42, a piston rod 43, a sealer 44, a second piston 45, a high pressure leakage proof packing 46 and a second hydraulic cylinder 47. The first hydraulic cylinder 41 has the same length as the second hydraulic cylinder 47, but has a smaller diameter than the second hydraulic cylinder 47. The two hydraulic cylinders 41 and 47 have the same stroke and move at the same speed. As the second hydraulic cylinder 47 has a larger diameter than the first hydraulic cylinder 41, the second hydraulic cylinder 47 has a higher flow rate than the first hydraulic cylinder 41. The first hydraulic cylinder 41 is provided with a flange 411 adapted to engage with a flange 471 of the second hydraulic cylinder 47 so that the two hydraulic cylinders 41 and 47 can be secured together by screws. The sealer 44 is fitted in the open end of the first hydraulic cylinder 41 for separating the two hydraulic cylinders 41 and 47 into two regions. The oil of the hydraulic cylinders 41 and 47 are supplied by the main oil container 1 and the oil-retrieving container 6, respectively. The piston rod 43 extends through a center hole 441 of the sealer 44 (see FIG. 2). A packing ring 442 is fitted in the center hole 441 for sealing the clearance between the piston rod 43 and the center hole 441, with the piston rod 43 reciprocating through the center hole 441. The first piston 42 and the second piston 45 are each threadedly engaged with an end of the piston rod 43, so that when the hydraulic oil is forced to push the first piston 42, the piston rod 43 will be moved toward the sealer 44 thereby moving the second piston 45 to force the hydraulic oil into the hydraulic pressure storage trough 5, as shown in FIGS. 3, 3A, 3B and 4.

Figure 3:
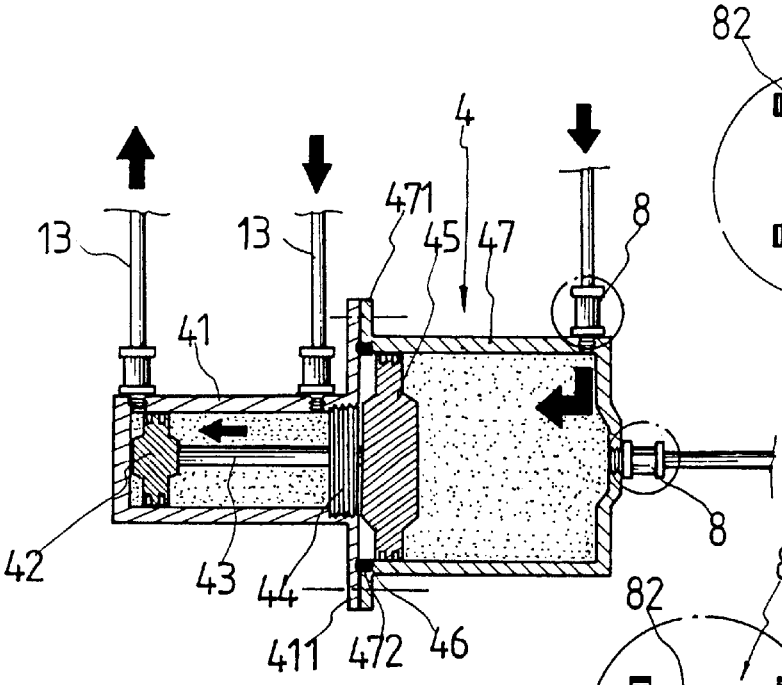
FIG. 3 is a sectional view of the twin-circuitry hydraulic cylinder mechanism.
Figure 3A:
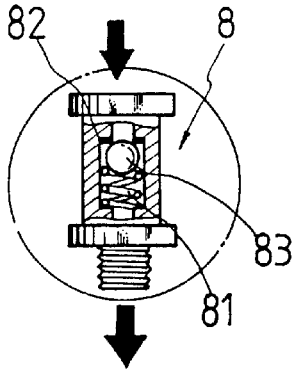
FIG. 3A is a sectional view of the check valve mounted at the inlet of the twin-circuitry hydraulic cylinder mechanism.
Figure 3B:
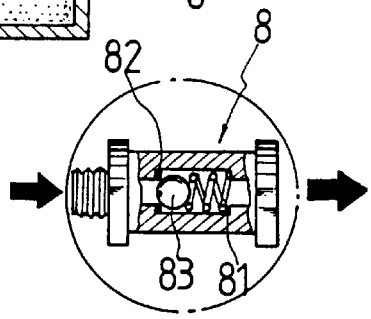
FIG. 3B is a sectional view of the check valve mounted at the outlet of the twin-circuitry hydraulic cylinder mechanism.
Figure 4:
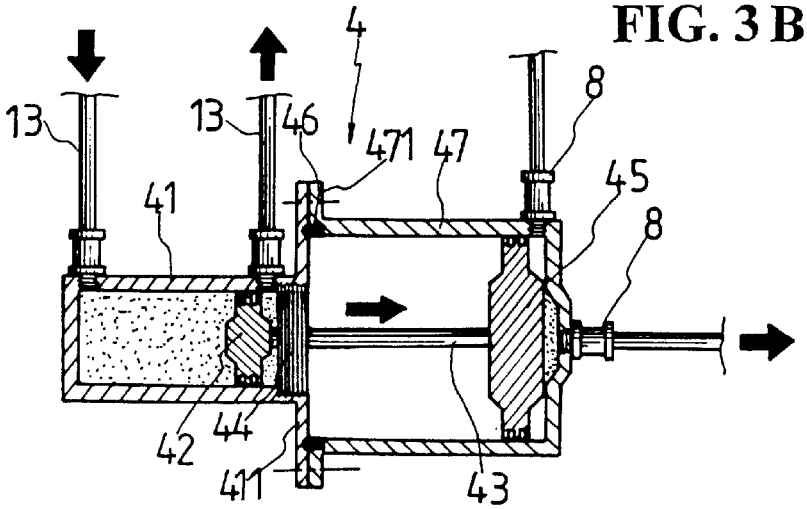
FIG. 4 illustrates the working principle of the twin-circuitry hydraulic cylinder mechanism.

Looking now at FIGS. 1, 3, 3A, 3B and 4, the hydraulic cylinder 41 receives hydraulic oil from the main oil container 1 thereby forming a small circulatory system, while the second hydraulic cylinder 47 receives hydraulic oil from the oil retrieving container 6 thus forming a large circulatory system with the hydraulic pressure storage trough 5 and the driving tool 7. The second hydraulic cylinder 47 is provided with a check valve 8 at both the inlet and outlet thereof. The check valve 8 includes a spring 81, a packing ring 82 and a steel ball 83, as shown in FIGS. 3A and 3B. As the second piston 45 is moved toward the first hydraulic cylinder 41, the second hydraulic cylinder 47 will become vacuum thereby attracting the steel ball 83 to move inwardly and therefore opening the check valve 8. Hence, the hydraulic oil is rapidly filled into the second hydraulic cylinder 47 from the oil retrieving container 6. In the meantime, the check valve 8 at the outlet of the second hydraulic cylinder 47 enables hydraulic oil to flow out from the second hydraulic cylinder 47 only. When the second piston 45 is forced to move away from the sealer 44, the check valve 8 at the inlet of the second hydraulic cylinder 47 is closed, but the check valve at the outlet of the second hydraulic cylinder 47 is open thereby enabling the hydraulic oil to flow into the hydraulic pressure storage trough 5 from the second hydraulic cylinder 47.

Figures 12A, 12B:
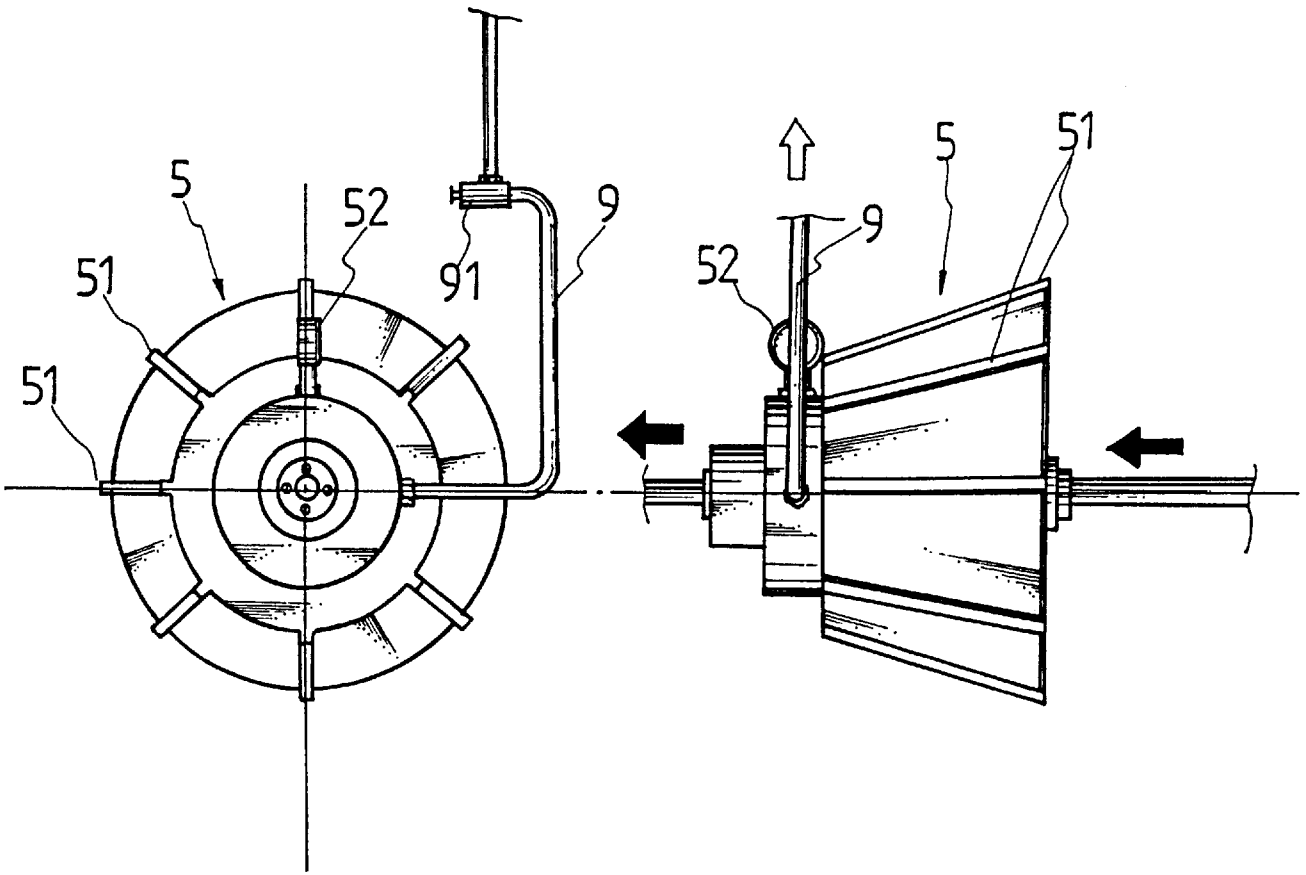
FIG. 12A is a front view of the hydraulic pressure storage trough.
FIG. 12B is a side view of the hydraulic pressure storage trough.

Looking now at FIGS. 12A and 12B, the hydraulic pressure storage trough 5 is provided with a plurality of ribs 51 at the outer side for reinforcing the structure thereof A pressure gauge 52 and a high pressure relief piping 9 are mounted on the hydraulic pressure storage trough 5. If the internal pressure exceeds the predetermined value, a relief valve 91 will be open to transmit the hydraulic oil back to the oil retrieving container 6 thereby ensuring safety.

Figure 13:
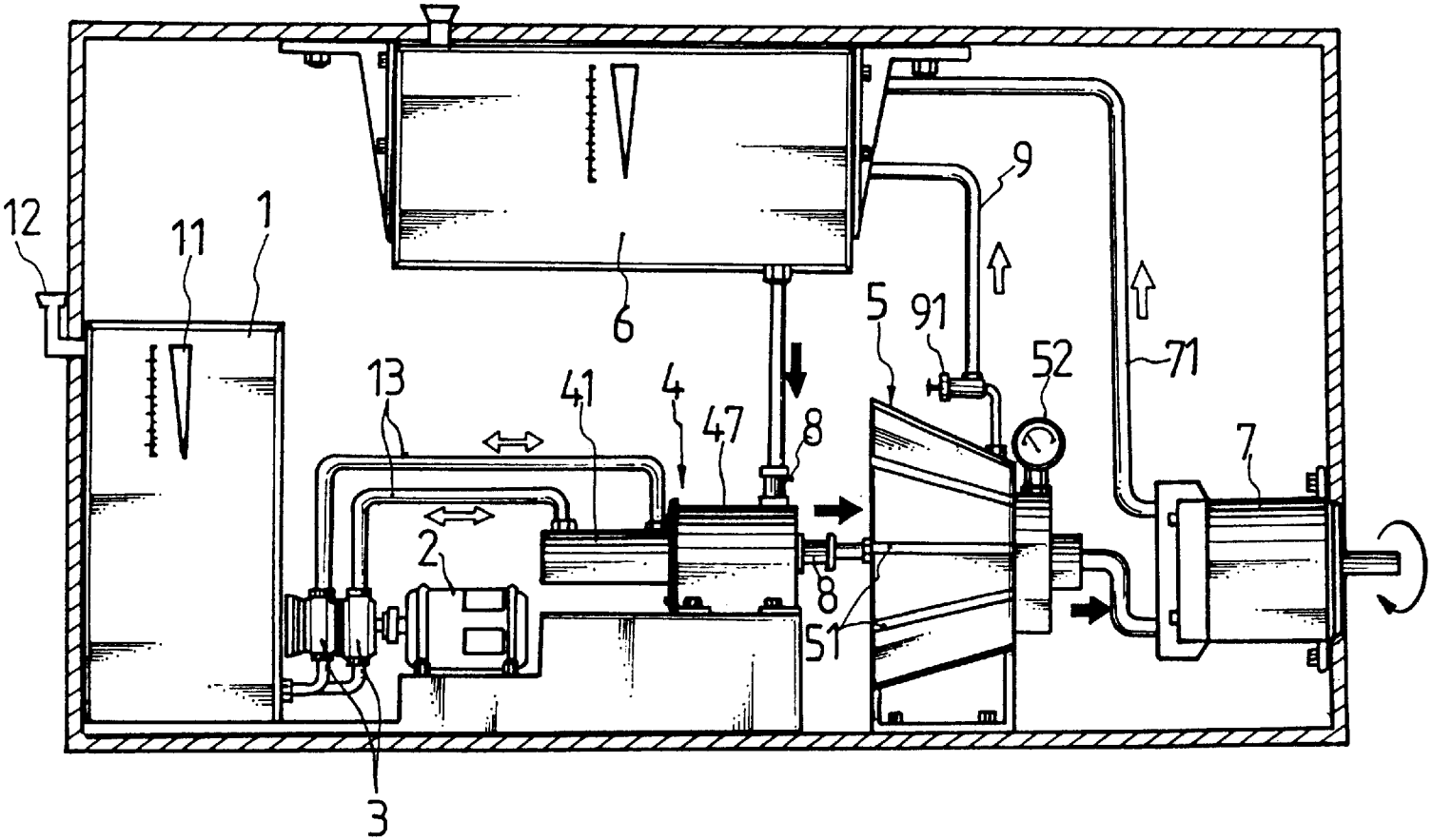
FIG. 13 is a side view of the present invention.

Referring to FIG. 13, the present invention utilizes the twin-circuitry hydraulic cylinder mechanism 4 as a power source, and provides a small circulatory system constituted by the first hydraulic cylinder 41, the main oil container 1, the motor 2 and the hydraulic pump 3 and a large circulatory system constituted by the second hydraulic cylinder 47, the hydraulic pressure storage trough 5, the driving tool 7 and the oil retrieving container 6. By means of the large circulatory system, the driving tool 7 will be driven to supply power to a high loading device. After use, the hydraulic oil will be fed back to the oil retrieving container 6 via a pipe 71.

Figure 5:
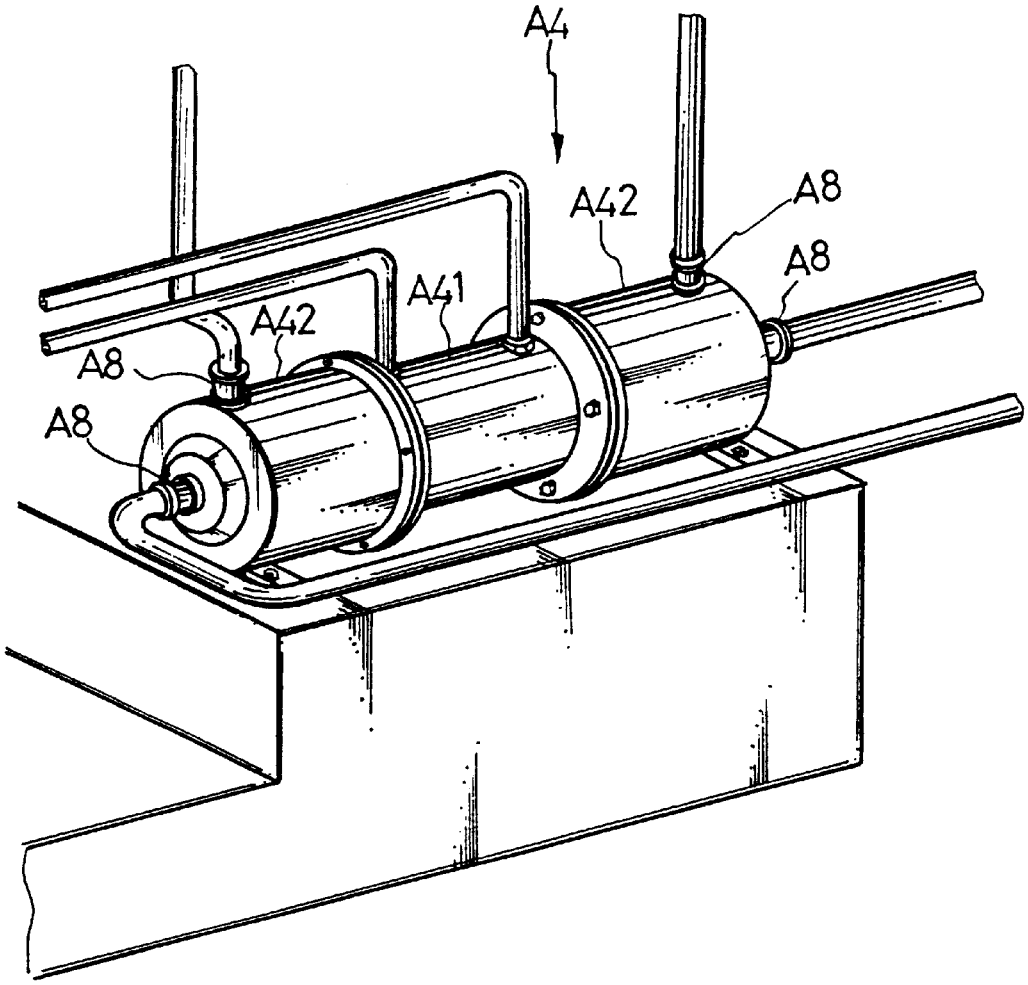
FIG. 5 illustrates a second preferred embodiment of the present invention.
Figure 6:
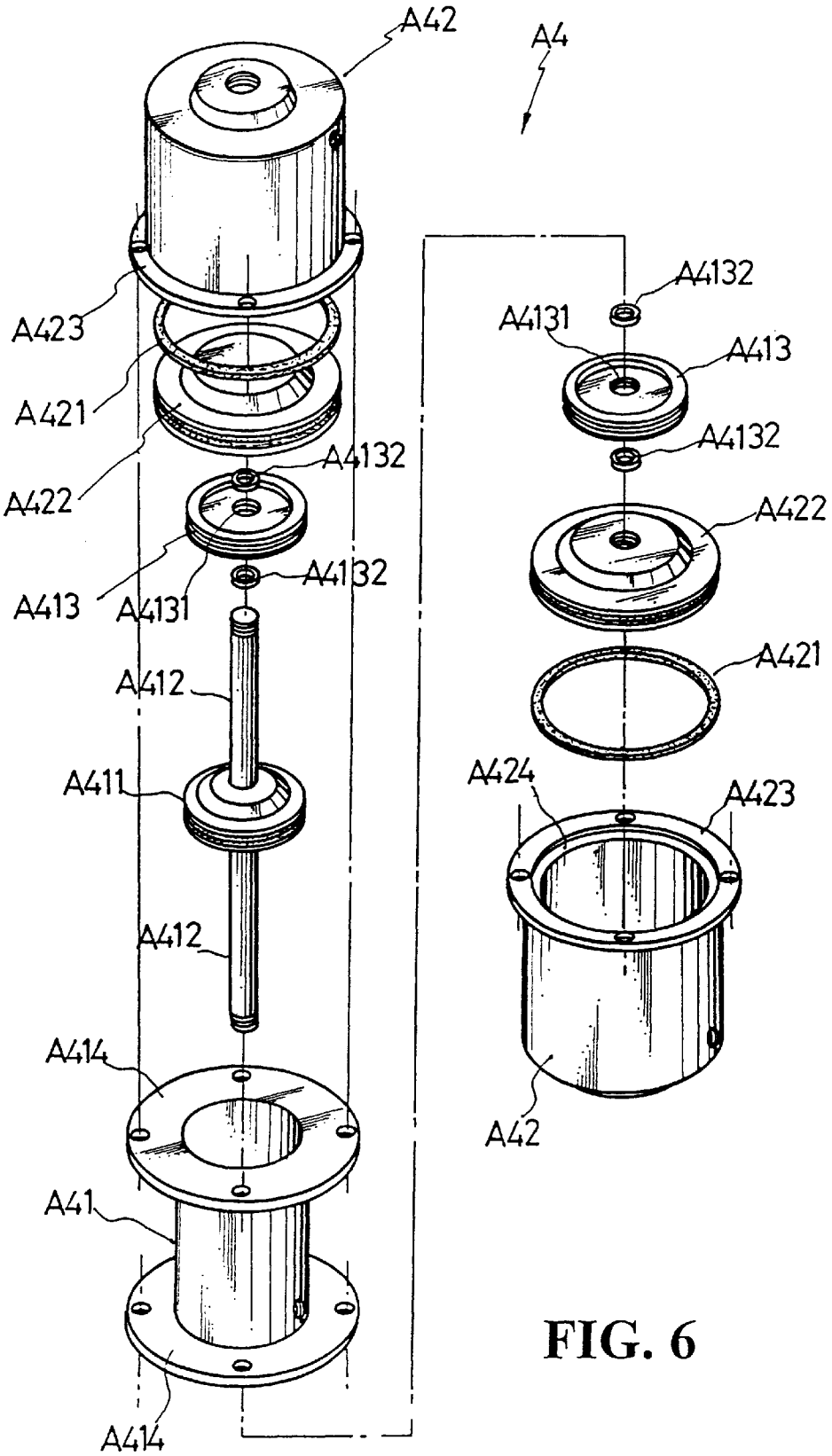
FIG. 6 is a perspective view of the second preferred embodiment.
Figure 7:
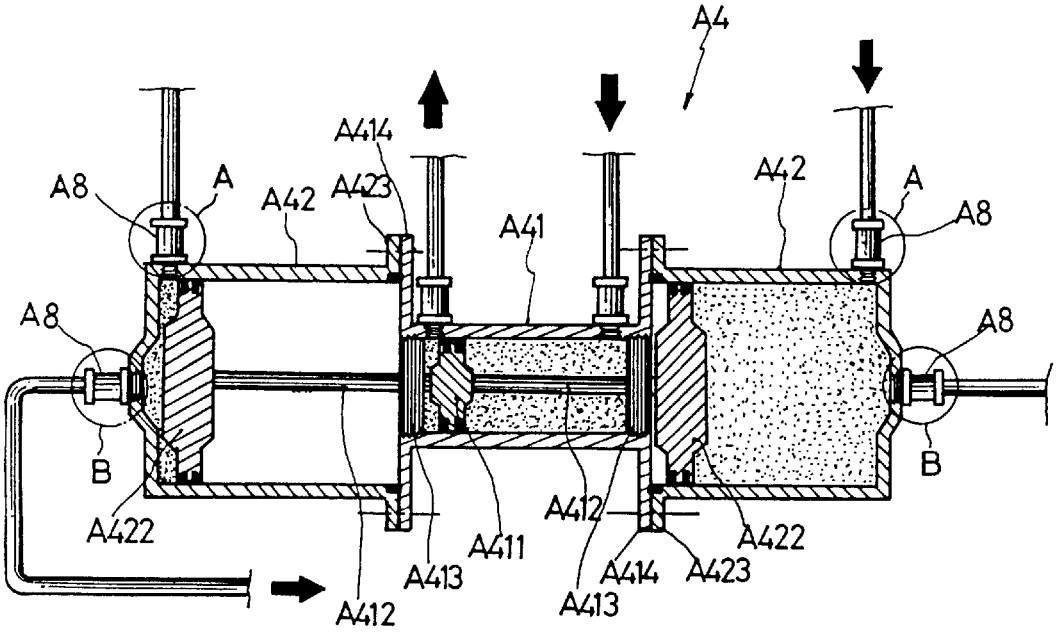
FIG. 7 is a sectional view of the present invention.
Figure 7A:
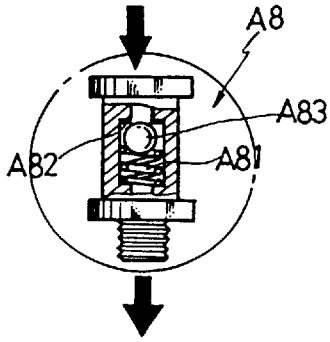
FIG. 7A is a sectional view of the portion A of FIG. 7.
Figure 7B:
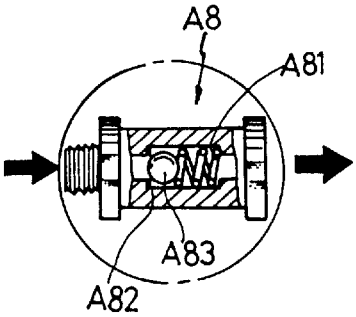
FIG. 7B is a sectional view of the portion B of FIG. 7.

FIGS. 5 and 6 illustrate a second preferred embodiment of the present invention. As shown, the twin-circuitry hydraulic cylinder mechanism comprises a reciprocating hydraulic cylinder A41, a piston A411, a piston rod A412, a sealer A413, front and rear hydraulic cylinders A42, a high pressure leakage proof packing A421, and front and rearpistions A422. The cylinders A41 and A42 are formed with flanges A414 and A423. Two ends of the cylinder A41 are engaged with two sealers A413. Two ends of the piston rod A412 extend through the center holes A4131 of the two sealers A413 to engage with the front and rear pistons A422. Further, a packing ring A4132 is fitted in the center hole A4131. As shown in FIGS. 7, 7A and 7B, the outlet and inlet of the front and rear hydraulic cylinders are provided with check valves A8 which include a spring A81, a packing A82 and a ball A83.

Figure 8:
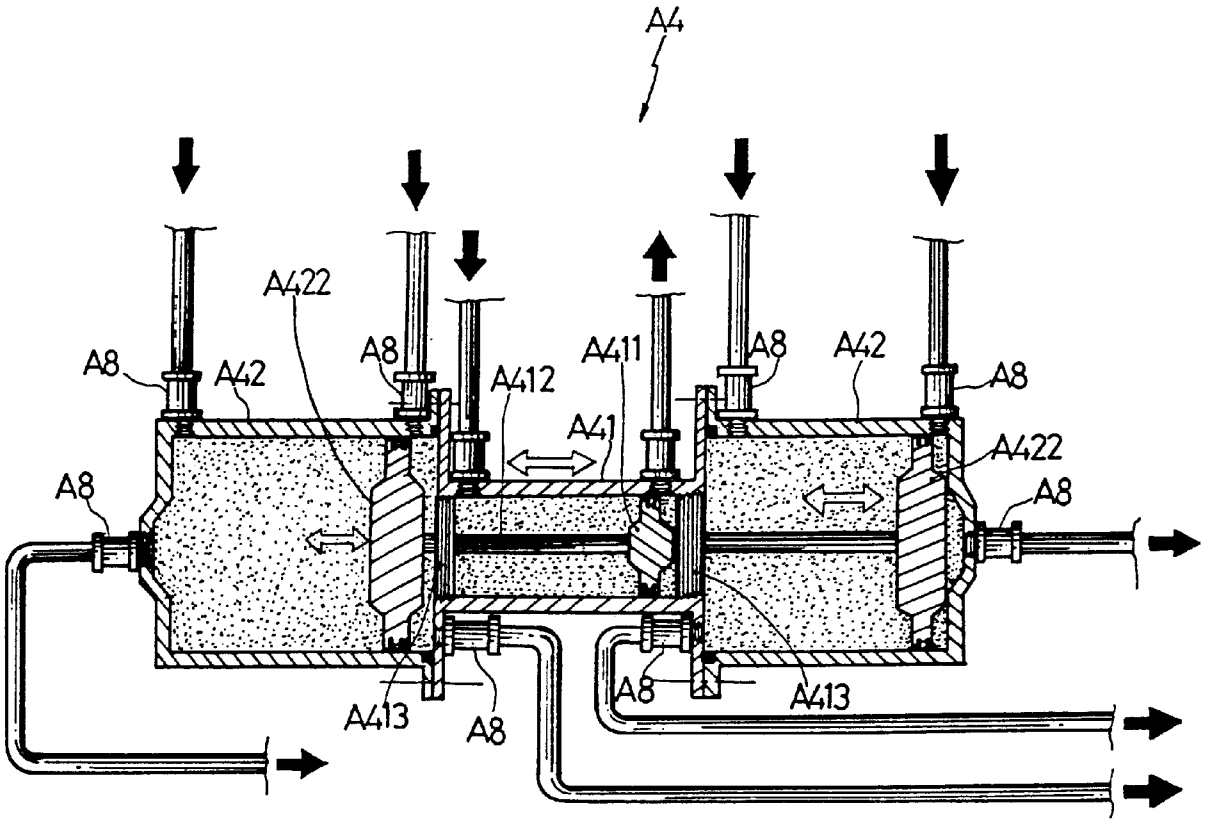
FIG. 8 is a sectional view of a third preferred embodiment of the present invention.

FIG. 8 illustrates a third preferred embodiment of the present invention. As shown, the third preferred embodiment is provided with an additional set of check valves at the rear section of the front and rear hydraulic cylinders A42 so as to provide higher flow rate.

Figure 9:
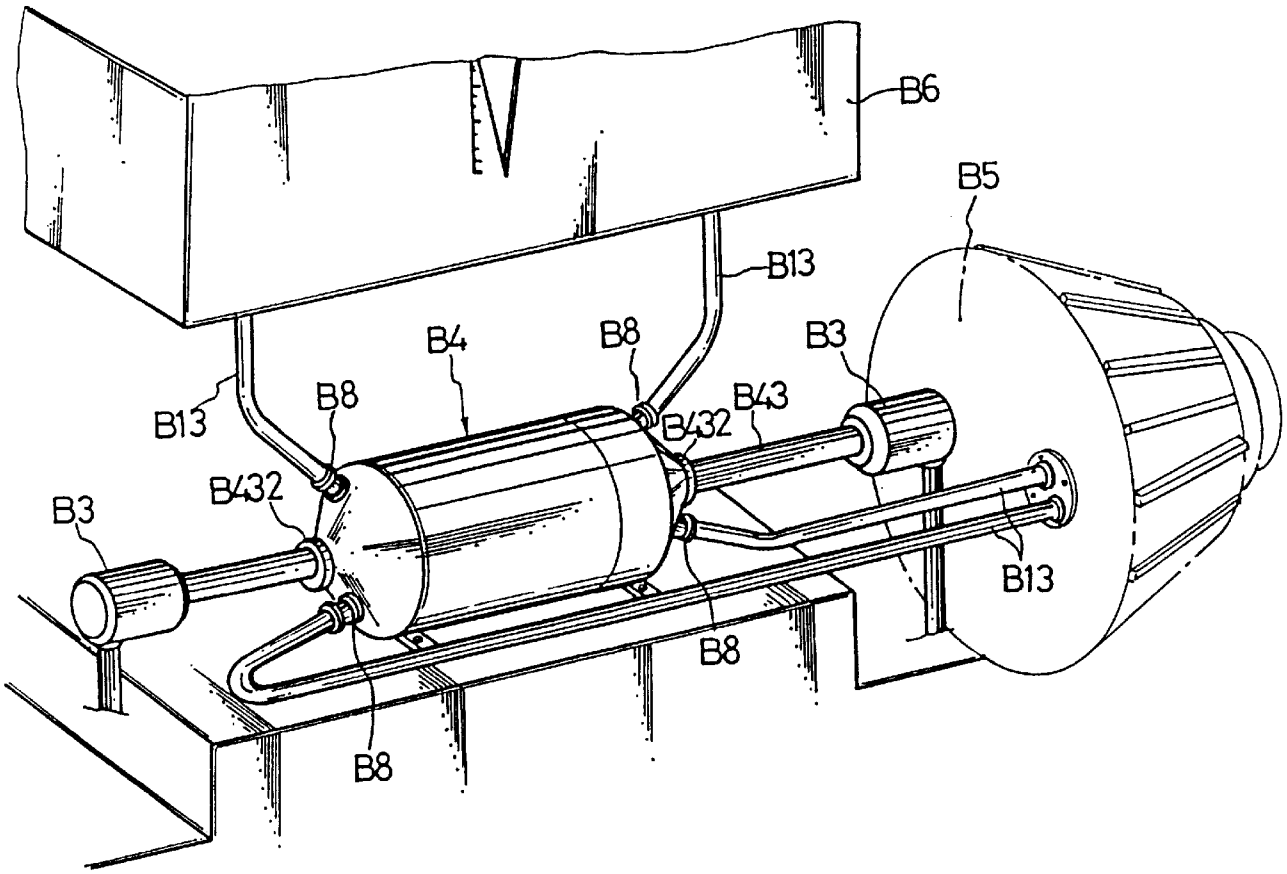
FIG. 9 illustrates a fourth preferred embodiment of the present invention.
Figures 10, 10A, 10B:
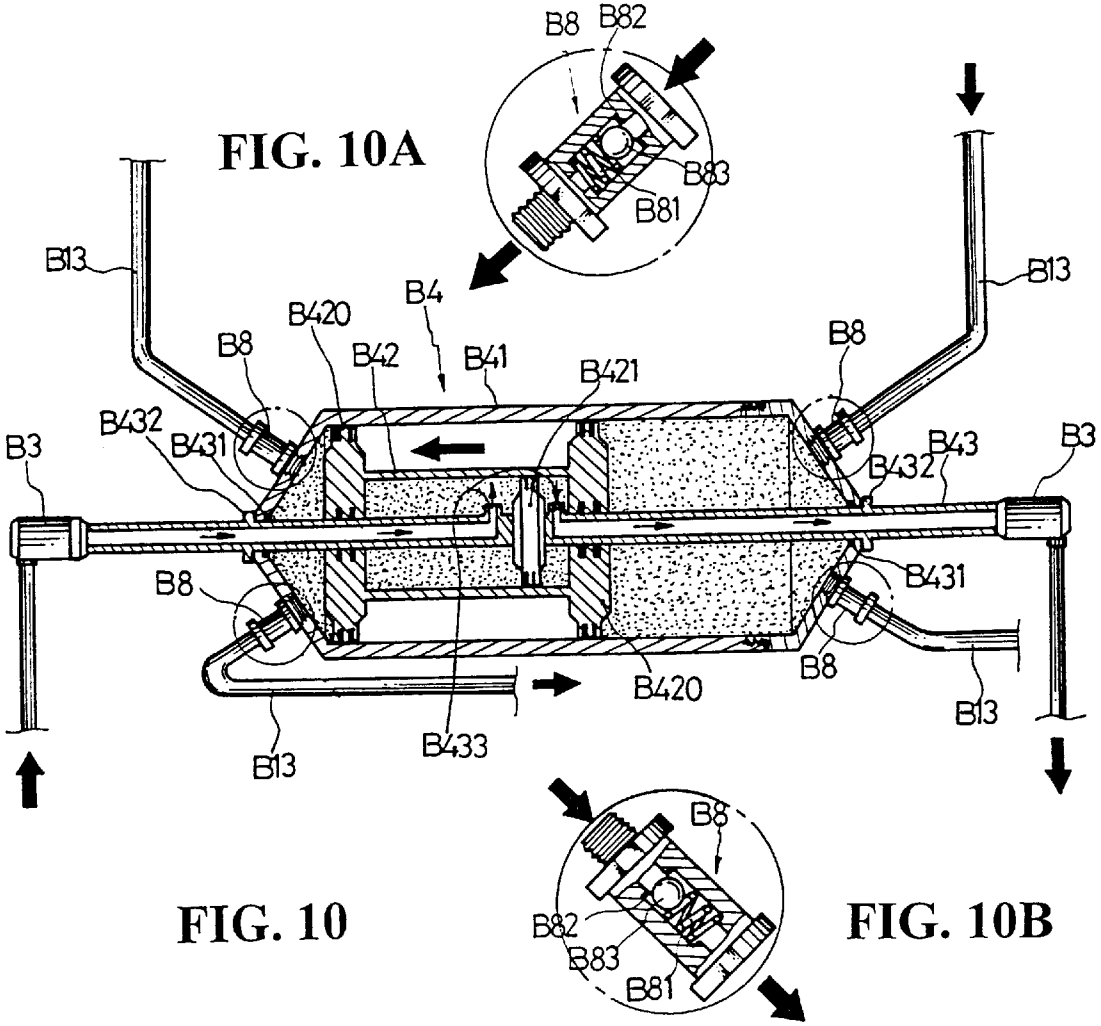
FIG. 10 is a sectional view of the fourth preferred embodiment.
FIG. 10A is an enlarged sectional view of the inlet of FIG. 10.
FIG. 10B is an enlarged sectional view of the outlet of FIG. 10.

FIGS. 9 and 10 illustrate a fourth preferred embodiment of the present invention. As shown, the twin-circuitry hydraulic cylinder mechanism B4 comprises two inlet high pressure pipes and two outlet high pressure pipes B13 which are connected to the oil retrieving container B6 and the hydraulic pressure storage trough B5. The mechanism B4 further comprises an outer hydraulic cylinder B41, an inner hydraulic cylinder casing B42, a piston B421, a pipe B43, leak-proofpackings B431 and four check valves B8. The inner hydraulic cylinder casing B42 is provided at two ends with two pistions B421 thereby forming a piston B420 for the outer hydraulic cylinder B41. The pipe B43 has two flanges B432 close to two ends thereof which are connected to two pumps B3. The pipe B43 has an orifice B433 for the passage of hydraulic oil. Referring to FIGS. 10A and 10B, the check valve B8 includes a spring B81, a packing B82 and a ball B83.

Figure 11:
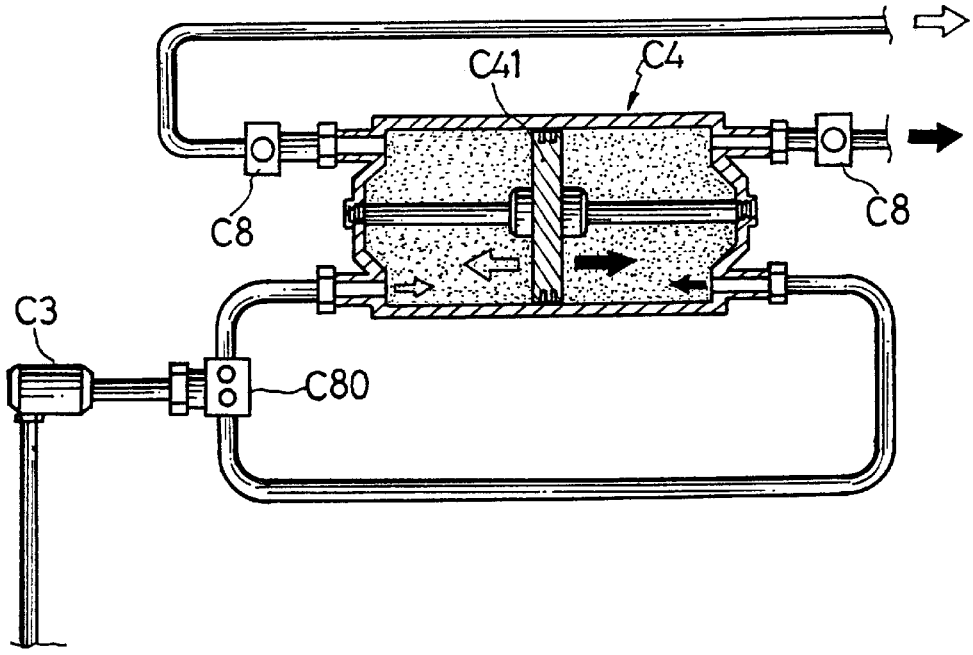
FIG. 11 illustrates a fifth preferred embodiment of the present invention.

FIG. 11 illustrates a fifth preferred embodiment of the present invention. As shown, the preferred embodiment comprises a bi-directional single-piston hydraulic cylinder C4 and utilizes a hydraulic pump C3 to control the piston C41 via the automatic control valve C80. However, the hydraulic oil supplied to the driving tool 7 will be directly fed back to the main oil container 1 without passing through the oil retrieving container 6. Further, the outlet at both ends of this embodiment is controlled by solenoid valve C8.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A hydraulic power conversion device comprising:

a main oil container having an inlet for supplementing hydraulic oil;

a pair of hydraulic pumps connected to said main oil container;

a motor drivingly connected with said hydraulic pumps;

a twin-circuitry hydraulic cylinder mechanism including a first hydraulic cylinder, a first piston, a piston rod, a sealer, a second piston, a high pressure leakage proof packing and a second hydraulic cylinder, said first hydraulic cylinder having same length as said second hydraulic cylinder but having a smaller diameter than said second hydraulic cylinder, said first hydraulic cylinder being connected with said second hydraulic cylinder by screws, said sealer being fitted between said first and second hydraulic cylinders to form two regions, said second hydraulic cylinder having an inlet provided with a first check valve and an outlet provided with a second check valve;

an oil retrieving container connected with said inlet of said second hydraulic cylinder; and a hydraulic pressure storage trough connected with said outlet of said second hydraulic cylinder;

said hydraulic pressure storage trough being provided with a relief valve which is in turn connected with said oil retrieving container;

each of said first and second check valves including a packing ring, a steel ball, and a spring urging said steel ball against said packing ring;

a third hydraulic cylinder which has same stricture as said second hydraulic cylinder and arranged on another side of said first hydraulic cylinder.

2. The hydraulic power conversion device as claimed in claim 1, wherein said third hydraulic cylinder is provided with a check valve.

3. The hydraulic power conversion device as claimed in claim 1, wherein said first and third hydraulic cylinders are provided with an additional check valve at outlet and inlet thereof.

* * * * *